US008939783B2

(12) United States Patent
Pfeiffer

(10) Patent No.: US 8,939,783 B2
(45) Date of Patent: Jan. 27, 2015

(54) ELECTRICAL PLUG-IN CONNECTOR COMPRISING A RAISED RELEASE ELEMENT, AND METHOD FOR REVERSIBLY CONNECTING AND DISCONNECTING PLUG PARTS OF A PLUG-IN CONNECTOR

(75) Inventor: Wolfgang Pfeiffer, Kuenzelsau (DE)

(73) Assignee: Intercontec Pfeiffer GmbH, Niederwinkling (DE)

( * ) Notice: Subject to any disclaimer, the term of this patent is extended or adjusted under 35 U.S.C. 154(b) by 65 days.

(21) Appl. No.: 13/811,188

(22) PCT Filed: Oct. 11, 2011

(86) PCT No.: PCT/EP2011/067716

§ 371 (c)(1),
(2), (4) Date: Jan. 18, 2013

(87) PCT Pub. No.: WO2012/049169

PCT Pub. Date: Apr. 19, 2012

(65) Prior Publication Data

US 2013/0122735 A1 May 16, 2013

(30) Foreign Application Priority Data

Oct. 12, 2010 (DE) ..... 10 2010 042 354

(51) Int. Cl.
*H01R 13/62* (2006.01)
*H01R 13/72* (2006.01)
(Continued)

(52) U.S. Cl.
CPC ..... *H01R 13/72* (2013.01); *H01R 13/6273* (2013.01); *H01R 13/633* (2013.01); *H01R 13/62905* (2013.01); *Y10S 439/923* (2013.01)
USPC ..... 439/314; 439/923

(58) Field of Classification Search
CPC ..... H01R 13/625
USPC ..... 439/314–319, 312, 923, 474
See application file for complete search history.

(56) References Cited

U.S. PATENT DOCUMENTS 2,431,268 A * 11/1947 McIntyre ..... 285/317
2,510,125 A * 6/1950 Meakin ..... 174/47
(Continued)

FOREIGN PATENT DOCUMENTS

CH 624245 A5 7/1981
DE 3042185 A1 5/1981
(Continued)

OTHER PUBLICATIONS

International Search Report for PCT/EP2011/067716 dated Feb. 16, 2012.

*Primary Examiner* — Neil Abrams
(74) *Attorney, Agent, or Firm* — Fitch, Even, Tabin & Flannery, LLP

(57) ABSTRACT

The invention relates to a plug-in connector comprising a first and a second plug part which can be reversibly coupled and disconnected in a bayonet manner with axial and rotational movements, wherein a connection device is designed that has at least one spring element, at least one spring piece of which engages with a sliding guide in the second plug part in order to connect the plug parts. The sliding guide and the spring element are designed such that the plug parts are automatically disconnected when a release threshold value is exceeded. A raised release element which is embraced by the spring piece in the plugged state of the plug parts is formed on the sliding guide. Said raised release element is rectilinear in the circumferential direction around the longitudinal axis (A) and extends on the same axial sectional level across the width of the release element when viewed in the axial direction in such a way that when a tensile force that is greater than the release threshold value is applied to the plug parts, the spring piece is guided over the raised release element exclusively in the axial direction in order to automatically disconnect the plug parts.

14 Claims, 5 Drawing Sheets

Figure 1:
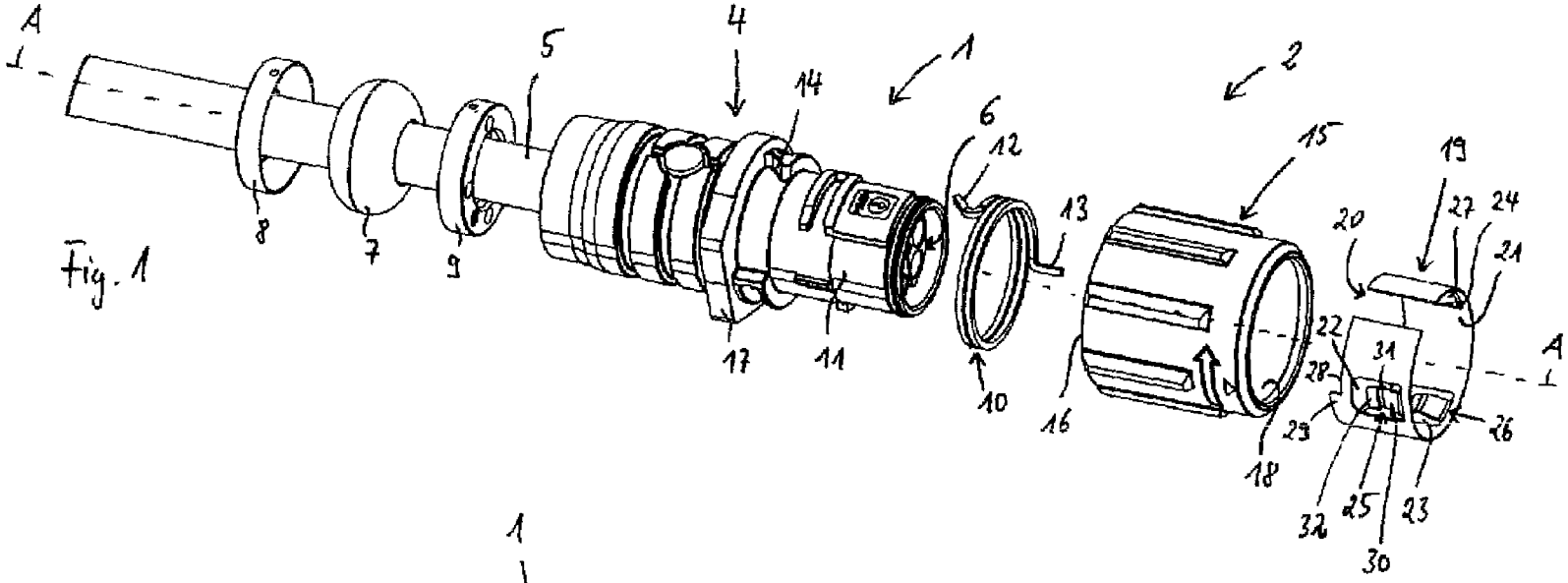

(51) Int. Cl.

| | |
|---|---|
| ***H01R 13/627*** | (2006.01) |
| ***H01R 13/633*** | (2006.01) |
| *H01R 13/629* | (2006.01) |

(56) References Cited

U.S. PATENT DOCUMENTS

| | | | | | |
|---|---|---|---|---|---|
| 2,933,711 | A | | 4/1960 | Eaton | |
| 3,008,115 | A | * | 11/1961 | Oakes | 439/160 |
| 3,680,033 | A | * | 7/1972 | Kawai | 439/352 |
| 4,077,690 | A | * | 3/1978 | Koether | 439/320 |
| 4,146,288 | A | * | 3/1979 | Ramsay et al. | 439/316 |
| 4,157,855 | A | * | 6/1979 | Chan | 439/155 |
| 4,166,664 | A | * | 9/1979 | Herrmann, Jr. | 439/258 |
| 4,550,967 | A | * | 11/1985 | Riches et al. | 439/332 |
| 4,583,084 | A | * | 4/1986 | Henderson et al. | 340/573.4 |
| 5,021,002 | A | * | 6/1991 | Noschese | 439/352 |
| 5,266,040 | A | * | 11/1993 | Merrill et al. | 439/159 |
| 5,486,117 | A | * | 1/1996 | Chang | 439/357 |
| 5,752,847 | A | * | 5/1998 | McCormick | 439/349 |
| 6,609,833 | B1 | | 8/2003 | Miyachi et al. | |
| 6,776,638 | B2 | | 8/2004 | Thurston | |
| 6,910,911 | B2 | * | 6/2005 | Mellott et al. | 439/358 |
| 7,040,910 | B2 | * | 5/2006 | Nagata et al. | 439/352 |
| 7,052,282 | B2 | * | 5/2006 | Meleck et al. | 439/34 |
| 7,163,413 | B2 | * | 1/2007 | Murayama | 439/258 |
| 7,252,533 | B1 | * | 8/2007 | Lee | 439/382 |
| 7,329,139 | B2 | * | 2/2008 | Benham | 439/352 |
| 7,470,137 | B2 | * | 12/2008 | Burke et al. | 439/344 |
| 7,758,370 | B1 | * | 7/2010 | Flaherty | 439/352 |
| 8,764,469 | B2 | * | 7/2014 | Lamb | 439/258 |
| 2002/0064983 | A1 | * | 5/2002 | Patey | 439/152 |
| 2006/0183375 | A1 | | 8/2006 | Benham | |
| 2013/0122735 | A1 | * | 5/2013 | Pfeiffer | 439/372 |

FOREIGN PATENT DOCUMENTS

| | | | |
|---|---|---|---|
| DE | 102009007534 | A1 | 8/2010 |
| GB | 1568210 | | 10/1977 |

* cited by examiner

ELECTRICAL PLUG-IN CONNECTOR COMPRISING A RAISED RELEASE ELEMENT, AND METHOD FOR REVERSIBLY CONNECTING AND DISCONNECTING PLUG PARTS OF A PLUG-IN CONNECTOR

CROSS REFERENCE TO RELATED APPLICATIONS

This application is a national phase application of International Application No. PCT/EP2011/067716, filed Oct. 11, 2011, claiming priority to German Application No. 10 2010 042 354.8, filed Oct. 12, 2010, both of which are incorporated by reference herein in their entirety.

The invention relates to an electrical plug-in connector with two plug parts, which can be reversibly coupled and disconnected. Such a plug-in connector, which moreover also ensures that in the connected state of the two plug parts upon effect of a tensile force with a force value greater than a release force threshold value on at least one of the plug parts, automatic disconnection or separation of the plug parts is effected, is for example known from U.S. Pat. No. 2,933,711.

Besides the possibility that the user grips the two plug parts and disconnects them in user-operated and intended manner, the further possibility is provided that upon unexpected and for example also unintended tensile force effects on at least one of the two connected plug parts, they are automatically disconnected.

However, this known plug-in connector is only suitable in restricted manner with regard to the construction and the functionality. In this connection, in particular the cooperation of the arrangements and shapes of the spring element with the spring pieces as well as the sliding guide in a plug part results in problems to the effect that the automatic release functionality only conditionally functions. Moreover, plugging together is tedious and prone to wear due to the geometries, and undesired jams and spreads as well as deflections in particular of the spring pieces can occur, which compromises the functionality of the plug-in connection.

It is the object of the present invention to provide an electrical plug-in connector as well as a method for reversibly connecting and disconnecting plug parts of a plug-in connector, in which or with which simpler and lower-wear connection and disconnection of the plug parts are achieved and at the same time multi-optional disconnection of the plug parts can be effected both directed by the user and automatically upon tensile force effect on the plug parts.

This object is solved by a plug-in connector having the features according to claim 1, and a method having the features according to claim 14.

An electrical plug-in connector according to the invention includes a first plug part and a second plug part. The two plug parts can be reversibly coupled and disconnected. The plug-in connector includes a connection device, which has at least one spring element engaging with a sliding guide in the second plug part with at least one spring piece for connecting the plug parts. A raised release element is formed on this sliding guide, which is embraced by the spring piece in the plugged state of the plug parts. The sliding guide and the spring element are formed such that upon occurrence of a tensile force value greater than a release force threshold value on at least one of the two plug parts in the plugged state, automatic disconnection or non-destructive release of the plug parts being able to be reversibly performed is provided.

The raised release element is rectilinearly formed in circumferential direction. It extends at least over that width, preferably over its entire width, which is provided for guiding the spring piece over the raised release element, on the same axial sectional level viewed in axial direction. This means that at a specific considered location (specific axial sectional level) of the raised release element viewed in axial direction, the extension of the raised release element viewed in circumferential direction then extends over the entire width on this axial sectional level of the specific location starting from this specific location.

Upon occurrence of a tensile force greater than the release force threshold value on at least one of the two plug parts for automatically disconnecting the plug parts, then, the spring piece is guided over the raised release element exclusively in axial direction.

With such a configuration of a plug-in connector, thus, a particularly secure and reliably possibility is provided for being able to automatically disconnect or release the two connected plug parts in particularly simple and low-wear manner.

By the automatic disconnection, which is provided besides a disconnection directed by the user, critical states can be prevented. Especially if the coupled plug-in connector unintentionally experiences large tensile forces on a cable, for example if the cable entering the plug-in connector catches anywhere, damage or functional impairment can be prevented or states critical to safety can be avoided by the automatic disconnection.

By the automatic release function of the coupled plug parts provided purely in axial direction, thus, release can also be determined in particularly exact and defined manner. Thereby, the requirements when the automatic disconnection is to be reliably effected, can each be particularly exactly adjusted. By the explicitly representational configuration of a raised release element or an automatic raised disconnection element in its specific design and position, the functionality of the automatic disconnection can be particularly favorably achieved. By the extension of the raised release element with regard to the rectilinear extension in circumferential direction, thereby, an annular section is virtually formed as the raised element, which extends virtually partially circumferentially around the longitudinal axis of the plug-in connector and therein is always located on the same axial section over its width. Thereby, virtually, a retaining ramp for the spring piece is also formed such that undesired slipping in circumferential direction of the spring piece does not occur.

Preferably, the raised release element has an upper release edge, which transitions into a first abutment flank sloping down viewed in axial direction on the side facing away from the front end of the second plug part, wherein the first abutment flank leads to the bottom of the sliding guide. This is a configuration to be particularly emphasized since larger flat area is thereby formed by the abutment flank, which is able to be in contact with the embracing spring piece and thereby allows abutment of the spring piece and the raised release element as large-area as possible. On the one hand, thereby, mechanically stable positioning of the spring piece can be ensured, which in particular prevents undesired slipping or sliding in circumferential direction around the axial longitudinal axis. Moreover, by this configuration of the first abutment flank and the abutment of the spring piece thereon as large-area as possible, extremely precise adjustment and substantially also continuously directed automatic disconnection can be effected. Thus, as the spring piece is not extremely abruptly pulled over a virtually perpendicular step, the longevity and the low wear of the plug-in connector can also be taken into account. Furthermore, by the oblique first abutment flank, precise release geometry is provided for the spring piece, which contributes to determination of the release force threshold value, but above all defines the fundamental release and the beginning of the axial movement of the spring piece in automatic disconnection. In particular, thereby, specifically guided movement of the spring piece radially outwards towards the retaining sleeve can be preset.

The one spring piece preferably has two strip parts movable angled to each other and reversibly to each other and connected to each other, wherein the release force threshold value is adjustable at least by a presettable deformability upon pressing the spring piece to an inner side of the retaining sleeve in guiding the spring piece over the raised release element upon automatic disconnection.

The release force threshold value is in particular adjustable and presettable by the shape and deformability of the spring piece. In particular in interaction with the material and the configuration of the spring piece and/or the radial height of the raised release element and/or the distance of the raised release element to the inner side of the retaining sleeve, thus, extremely exact adjustment of the release force threshold value can be allowed. The functional principle of automatic disconnection can thereby be achieved in particular precision.

Preferably, the first abutment flank is inclined at an angle between 10° and 75°, preferably between 20° and 50°, in particular between 25° and 35°, especially 30°, with respect to the axial longitudinal axis. Thereby, particularly advantageous release and guide to the inner side of the retaining sleeve is achieved.

It is particularly advantageous if the inclination of the first abutment flank is adapted to the design and inclination of the spring piece or at least of that region of the spring piece, which is provided for contact with the raised release element. By this configuration, abutment as large-area as possible of the first abutment flank and the spring piece can be achieved in the plugged state of the plug parts. Thereby, the above mentioned advantages can be particularly well achieved.

Preferably, the raised release element has an upper release edge, which transitions into a second abutment flank sloping down viewed in axial direction on the side facing the front end of the second plug part. Preferably, the second abutment flank terminates at the front border of the second plug part. This too, favorably affects the axial movement and guide of the spring piece over the raised release element upon automatic disconnection of the plug parts. Also after crossing the release edge upon movement exclusively in axial direction of the spring piece, then, abrupt impact on the outer side of the second plug part is not effected, but here too, continuous and smooth transfer up to the front border of the second plug part is effected by the second sloping down abutment flank.

In particularly advantageous manner, the raised release element thus forms as a ramp sloping on both sides, which has its peak at the release edge.

Preferably, the second abutment flank is inclined at an angle between 5° and 40°, preferably between 5° and 20°, in particular 10°, with respect to the axial longitudinal axis.

It can be provided that the inclinations of the two abutment flanks are the same. Preferably, it is provided that the inclination of the first abutment flank is steeper than the inclination of the second abutment flank.

Preferably, the raised release element has a width (in circumferential direction around the longitudinal axis), which corresponds at least to the width of the spring piece. Here too, the aspect of the contact as large-area as possible of the spring piece with the raised release element can therefore be taken into account. Here too, thus, undesired tilting or twisting of the spring piece or undesired movement in circumferential direction or obliquely thereto can in particular be avoided. The desired and provided axial movement of the spring piece is also thereby supported upon automatic disconnection.

Preferably, it is provided that the plug-in connection particularly advantageously has a hollow-cylindrical retaining sleeve, which is disposed on the first plug part and rotatable relatively to the first plug part. By such a retaining sleeve, thus, the region, in which the two plug parts are fitted to each other in the plugged state and optionally overlap, are circumferentially covered and protected. In additional functionality, by the retaining sleeve and the relative rotatability thereof with respect to the first plug part, the user-desired and user-defined disconnection and assembly of the two plug parts can also be effected. Thus, the retaining sleeve is multi-functionally configured.

Particularly advantageously, it is provided that the retaining sleeve also serves as a support for the spring element. In particular, the spring element is received in the interior of the retaining sleeve and rotationally fixedly disposed on the retaining sleeve. Preferably, the positioning of the spring element in the interior of the retaining sleeve is provided such that it is completely received in the interior such that the spring element does not protrude beyond the retaining sleeve viewed in axial direction. By the retaining sleeve, a mechanically stable support for the spring element is formed such that it is disposed in positionally secure and low-wear manner.

In particular, the retaining sleeve is formed as an integral component, which is in particular manufactured of plastic. However, it can also be formed of metal.

In particular, the spring element is non-destructively detachably disposed on the inner side of the retaining sleeve in rotationally fixed manner. In particular for assembly or maintenance purposes, thus, the spring element can also be separated from the retaining sleeve.

Preferably, at a lower border of the spring element, a wall extension only partially protruding beyond the lower border is formed, which is formed for introducing into a detent on the inner side of the retaining sleeve. By this configuration, a particularly simple yet mechanically stable protection of the spring element in the retaining sleeve can be ensured.

In particular, the spring element is also integrally formed and the wall extension is integrated in the spring element.

Preferably, the spring element is formed of metal. The spring element can be introduced into the retaining sleeve and locked in it by simple insertion in axial direction.

Preferably, the retaining sleeve is disposed on the first plug part in a locking position preloaded with respect to the connection of the two plug parts by a spring, in particular a torsion spring, in its initial position non-operated by a user. Thus, a defined preload force is generated by the spring, by means of which the retaining sleeve is pressed into the locking position.

In particular, the relative movability of the retaining sleeve in the first plug part is ensured in circumferential direction, in particular only in circumferential direction.

This relative movability in circumferential direction is preset in an angular range of less than or equal to 90°.

Preferably, it is provided that the disconnection and connection of the two plug parts can also be effected by rotating the retaining sleeve from the locking position to a release position and axially moving the plug parts towards each other besides the exclusively axial movement and the axial guide of the spring piece over the raised release element effected thereby. Therein, the spring piece is guided past the raised release element in axial direction in a guide path section of the sliding guide formed next to the raised release element, in particular bounded by the raised release element on one side.

Besides the automatic disconnection, disconnection directed by the user is also possible. This too, is possible by two variants. In the same manner as in the automatic disconnection, a user can grip the plug parts and disconnect the plug parts by a purely axial pulling movement by purely axial movement.

However, a further disconnection directed by the user can also be effected by first rotating the retaining sleeve from the locking position into a release position and then axially moving the plug parts towards each other. Thus, in particular by the retaining sleeve, the multifunctional capability of disconnecting and connecting the plug parts is ensured. In particular, therein, it is provided that the spring piece is guided past the raised release element in axial direction in a guide path section of the sliding guide formed next to the raised release element, in particular bounded by the raised release element on one side.

By the very specific configuration of the sliding guide and the raised release element, thus, in very special functionality, both the automatic disconnection and the disconnection directed by the user by rotating the retaining sleeve and guiding the release part in the sliding guide is allowed.

Furthermore, it is also allowed that the connection of the plug parts can be performed in two different variants. On the one hand, it can occur to the effect that the user grips the two plug parts and joins the two plug parts exclusively in axial direction. If the two plug parts therein are brought to each other in the correct position each viewed in circumferential direction with regard to their coding and capability of being assembled, thus, this exclusively axial connection movement can be performed. Therein, the spring piece is then axially pushed over the raised release element and snaps into the sliding guide behind the raised release element. However, by the configuration of the rotatably supported retaining sleeve, optionally, it can also be provided that the user rotates this retaining sleeve from the locking position into the release position, then assembles the two plug parts, wherein the spring piece is exclusively moved in axial direction over the sliding guide and past the raised release element due to the release position of the retaining sleeve and then is moved only exclusively in circumferential direction in the sliding guide by rotating back the retaining sleeve into the locking position and virtually is introduced behind the raised release element viewed in axial direction.

Then, the spring piece is retained in this final position in the connected state of the plug parts behind the raised release element by the locking position of the retaining sleeve preloaded in circumferential direction around the longitudinal axis. The retaining sleeve in its preloaded condition thus also contributes to the positionally secure retention of the spring piece behind the raised release element. Undesired movement of the spring piece in circumferential direction or even undesired spiral path movement of the spring piece around the axial longitudinal axis of the plug-in connector can thereby securely be avoided.

Preferably, the sliding guide has a circumferentially horizontal guide path section bounded by the raised release element on one side, in which the spring piece is retained by the preloaded locking position of the retaining sleeve in the plugged state of the plug parts.

Moreover, the sliding guide is formed with a second vertical guide path section, which enters the horizontal guide path section. In particular, the vertical guide path section is also bounded by the side wall of the raised release element on one side, in particular a longitudinal side.

Preferably, the sliding guide is designed to the effect that it has a guide path section oriented exclusively in axial direction, which enters an exclusively horizontally formed guide path section. Thus, the sliding guide has two guide path sections, which therefore are in particular disposed at a 90° angle to each other. Particularly advantageously, it is provided that the respectively internal bounding walls of the sliding guide are formed by the raised release element. The raised release element is in particular designed and disposed such that it both constitutes a bounding wall of the axial guide path section and a bounding wall of the horizontal guide path section. In particular the bounding wall of the horizontal guide path section is the first abutment flank. Then, it is in particular formed downwardly sloping.

Particularly advantageously, the raised release element is formed with a height viewed in radial direction at the maximum, which corresponds to the height of the sliding guide. By such a configuration, thus, the raised release element does not protrude beyond the maximum exterior level of the sliding guide in radial direction.

By such a configuration of the sliding guide and in particular also the specific configuration and arrangement of the raised release element in cooperation with the designs and arrangements of the guide path sections, the simple, secure and low-wear connection and disconnection of the plug parts can be ensured in particularly precise, installation space minimized and highly functional manner, and in particular the automatic disconnection of the plug parts performed exclusively in axial direction can also particularly precisely be achieved.

Preferably, it is provided that the spring element is a hollow-cylindrical annular section, in which the at least one spring piece is integrally formed and is disposed in a hole of the wall of the annular section. By this configuration, the spring element is not completely closed in circumferential direction, but interrupted, whereby some desired elasticity and movability also in radial direction arises. By the integration of the spring piece and the arrangement in a hole configuration in the wall, the spring piece too can in particular be radially movably positioned, and moreover is also protected. Undesired deflection of the spring piece can thereby be avoided. By this hollow-cylindrical structure of the annular section, particularly flat configuration is also achieved viewed in radial direction such that the attachment to the inner side of the retaining sleeve can be particularly suitably effected without the radial thickness being too large thereby and other installation space in the interior of the retaining sleeve being restricted.

Preferably, it is provided that the spring element has three separate spring pieces disposed equidistantly to each other viewed in circumferential direction.

Preferably, a spring piece is strip-shaped formed. This strip includes a first plate-shaped strip part directed obliquely inwards, which then transitions into an outwardly bent second strip part. By the configuration, a particularly smooth-running and low-wear contact as large-area as possible of the raised release element is ensured and corresponding smooth-running guiding over the raised release element is ensured.

The strip parts disposed angled to each other are formed movably relatively to each other and thus configured in reversibly bendable or deformable manner, which contributes particularly advantageously to the precise specification of a release force threshold value. Especially in pressing to the inner side of the retaining sleeve upon guiding the spring piece over the raised release element, thereby, the release force threshold value is adjustable.

Preferably, the release force threshold value is greater than 9 N. Depending on the plug-in connector type and the employment purpose thereof, different release force threshold values can be provided. Thus, if the plug-in connector is connected to a cable along the connection chain with a further detachable coupling, it can be provided that for safety reasons the release force threshold value is smaller than the separation force threshold value depending on the separation force threshold value of the further coupling such that release of the connection chain is always effected at the plug parts of the plug-in connector upon unexpected occurrence of a tensile force on the connection chain. For example, then, a release force threshold value can be between 10 N and 60 N.

If such a requirement is not necessary or only a disconnection location is present in the connection chain, thus, the release force threshold value can also be higher, for example also greater than 70 N.

Particularly advantageously, the plug-in connector is provided for use at and/or connection to a medical apparatus. It is preferably a defibrillator.

Preferably, it is provided that the second plug part has the sliding guide with the raised release element on its outer side on the front end and the second plug part embraces the first plug part at least in the section overlapping in axial direction in the state connected to the first plug part. In this connection region, thus, the first plug part is formed with a smaller outer diameter than the inner diameter of the second plug part. Such a dimension and size principle too, allows a particularly suitable and low-wear and smooth-running realization of the connection and disconnection of the plug parts especially in interaction with the spring element, the configuration thereof as well as the sliding guide and the raised release element.

In particular, the plug parts to be coupled to each other are formed of metal. They can also at least partially be formed of plastic material. Each plug part is formed for receiving a specific contact arrangement support, wherein the two contact arrangement supports of the plug parts are provided for compatible connection. In this connection, thus, electrical contacts are provided in the contact supports of the plug parts.

Advantageously, a rear border of the plug housing of the second plug part is inwardly bent and thus oriented towards the longitudinal axis of the plug part. This bending of the border constitutes a retaining device for the components disposed in the interior of the plug housing, in particular at least a seal and at least a pressure ring, such that axial positional fixation of these components is achieved by this bending.

Preferably, the bending is effected by a tool, in particular a bending die. It preferably includes a socket for the rear end of the plug housing such that it can be introduced into the socket. Only after introduction, then, the rear border of the plug housing is contacted with an abutment surface of the socket upon further axially pushing together the die with the plug housing. The abutment surface is obliquely disposed and circumferentially formed such that a funnel-shaped or conical region is formed in the socket. Upon further axially pushing together, the rear border of the plug housing is then obliquely inwardly deflected by guiding along the abutment surface. By an axial resting surface formed in the socket and adjoining the abutment surface, then, the final bending state of the border is preset.

A further aspect of the invention generally relates to a plug part for an electrical plug-in connector, which has a hollow, in particular hollow-cylindrical plug housing. The plug housing is formed for connection to a further plug part of the plug-in connector at its front end. A rear end of the plug housing has a rear border, which is at least oriented or inclined obliquely inwardly towards the longitudinal axis of the plug housing in the manufactured state of the plug part. Thereby, at the rear end of the plug housing, a diameter restriction is formed. Thereby, components introduced into the plug housing, such as for example seal and/or pressure ring, can be axially positionally fixed in the interior of the plug housing.

Preferably, this plug part is formed like the second plug part of the above explained plug-in connector according to the invention or an advantageous implementation thereof. Preferably, the diameter restriction is formed by a die, wherein an axial relative movement between the plug part and the die towards each other is performed and then the rear border of the plug housing is bent inwardly in defined manner in a socket of the die.

Furthermore, the invention also relates to a method for reversibly connecting and disconnecting plug parts of an electrical plug-in connector, wherein a connection device is formed, which has at least one spring element. The spring element is formed engaging with a sliding guide in the second plug part for connecting the plug parts of the at least one spring piece, and a raised release element is formed on the sliding guide. The sliding guide is embraced by the spring pieces in the plugged state of the plug parts. With regard to this embraced state, it is understood that the spring piece comes to lie behind the raised release element viewed in axial direction. Upon exceeding a release force threshold value upon occurrence of a tensile force on at least one of the two plug parts, the plug-in connection is formed such that automatic disconnection of the plug parts is then effected. Upon occurrence of a tensile force greater than the release force threshold value on one of the two plug parts, the spring piece is pulled off or released exclusively in axial direction via the raised release element formed rectilinearly in circumferential direction and extending at least over its length, provided for transferring the spring piece, on the same level viewed in axial direction.

Preferably, the spring element is disposed internally in a retaining sleeve rotatably disposed on the first plug part rotationally fixed to the retaining sleeve. The embracement of the raised release element by the spring piece is retained in circumferential direction by means of a spring in the preloaded state of the retaining sleeve.

Preferably, in addition to the automatic disconnection, user-directed disconnection is allowed. This can be effected such that a retaining sleeve rotatably disposed on the first plug part is brought from its locking position preloaded by a spring into a release position by gripping the retaining sleeve and rotating by a user, whereby the spring piece coupled to the rotation of the retaining sleeve is moved along the raised release element and moved past it in particular exclusively only in horizontal direction, thus only in circumferential direction, and then upon reaching the release position, it is moved along an axial sliding guide section of the sliding guide extending past the raised release element and adjoining the raised release element by exclusive axial movement, and the plug parts are disconnected.

Advantageous developments of the plug-in connector device according to the invention are to be regarded as advantageous developments of the method according to the invention. In this connection, the representationally mentioned components are formed and interact such that the respective procedures and method steps for disconnecting and connecting can be performed.

Further features of the invention are apparent from the claims, the figures and the description of figures. The features and feature combinations mentioned above in the description, thus also the features and feature combinations only shown in the figures alone and/or only mentioned in the description of figures alone, are usable not only in the respectively specified combination, but also in other combinations or alone without departing from the scope of the invention.

Figure 2:
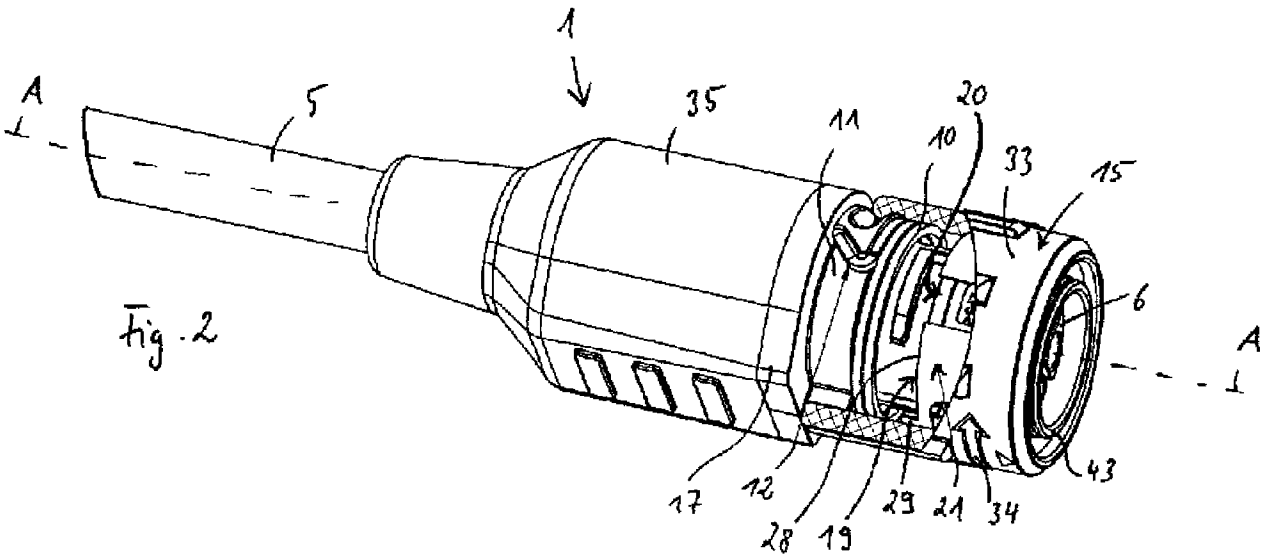
Figure 3:
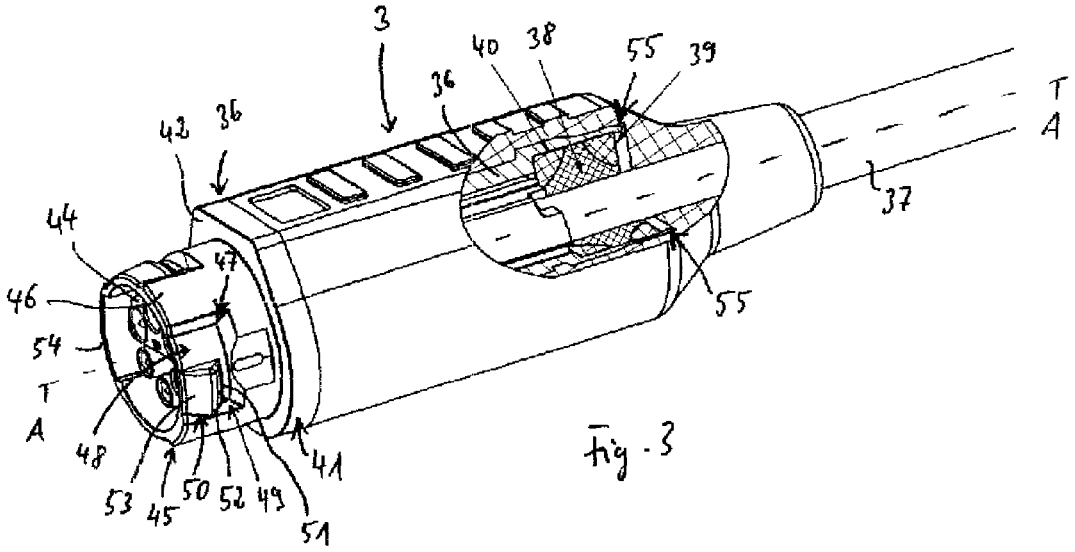
Figure 4:
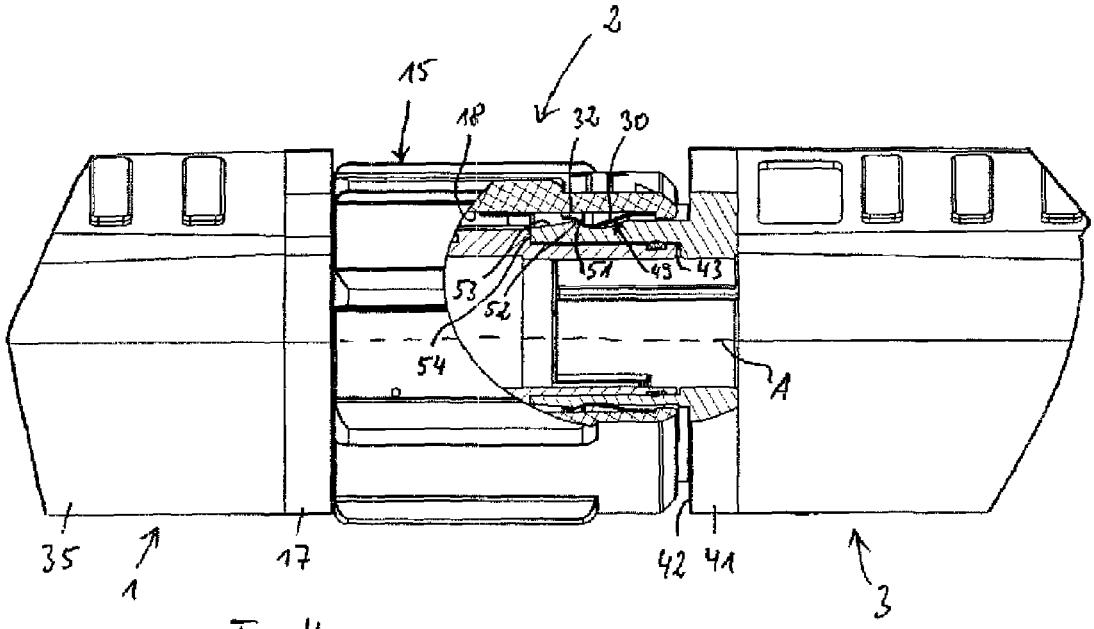
Figure 5:
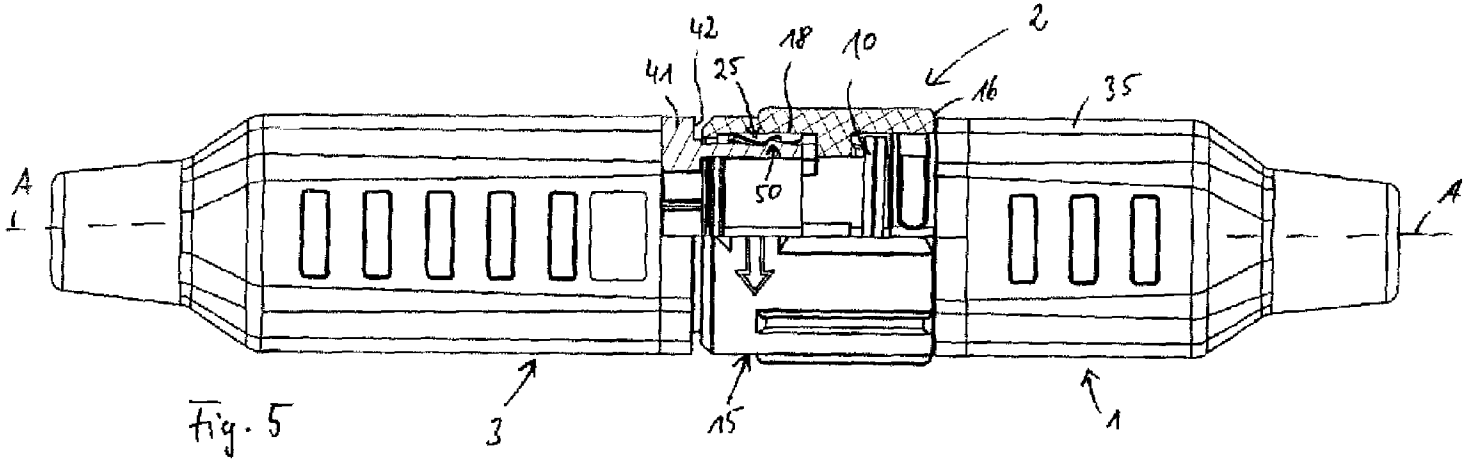
Figure 6:
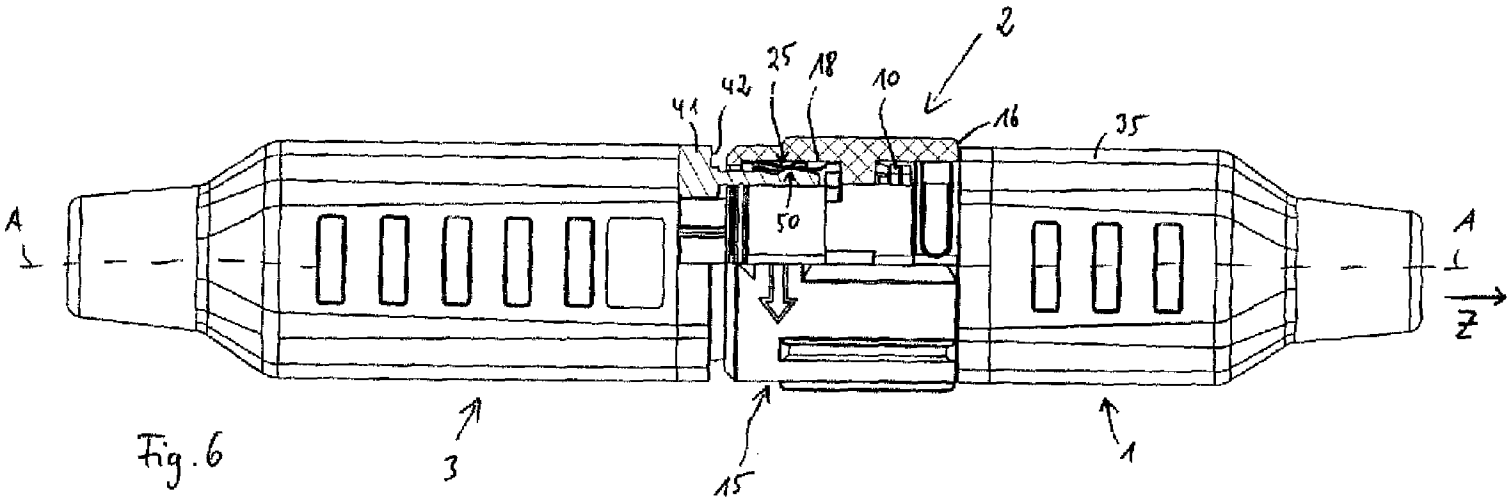
Figure 7:
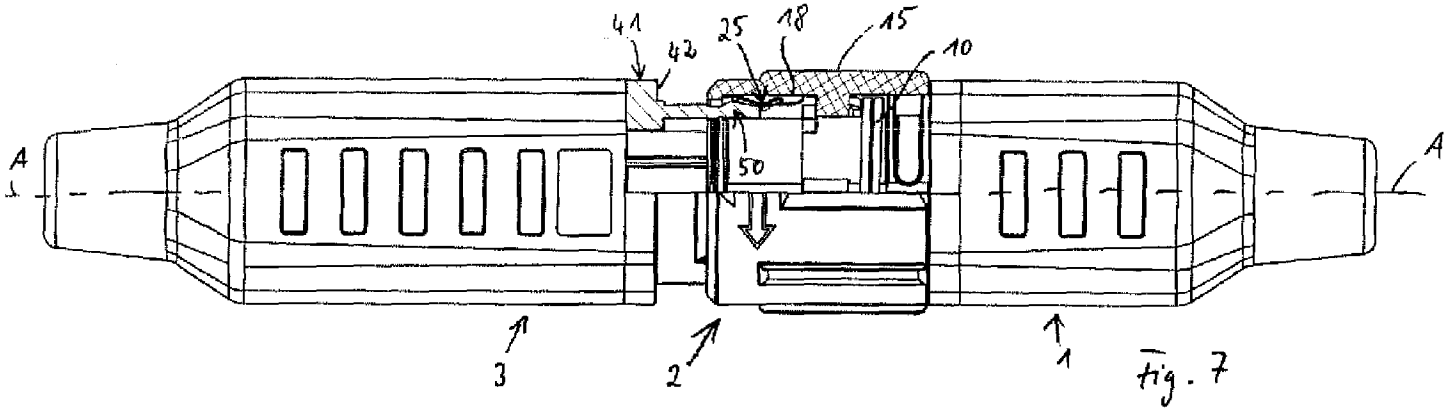
Figure 8:
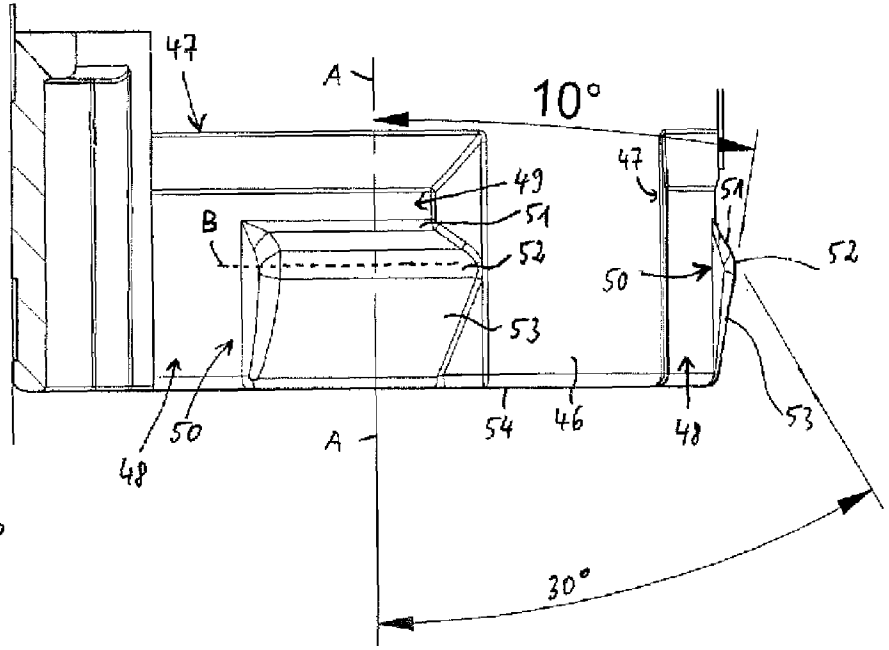
Figure 9:
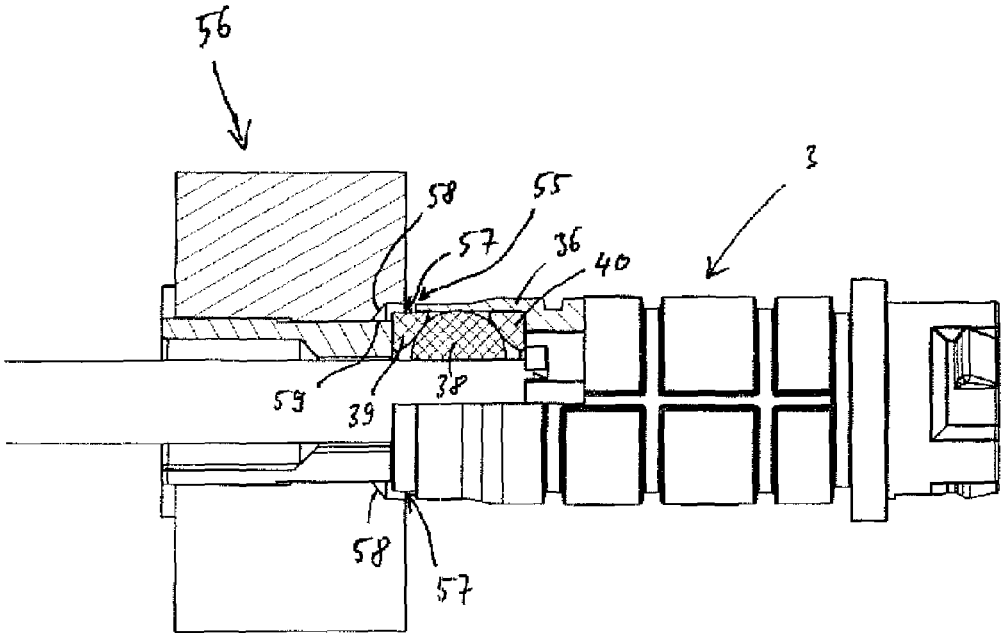
Figure 10:
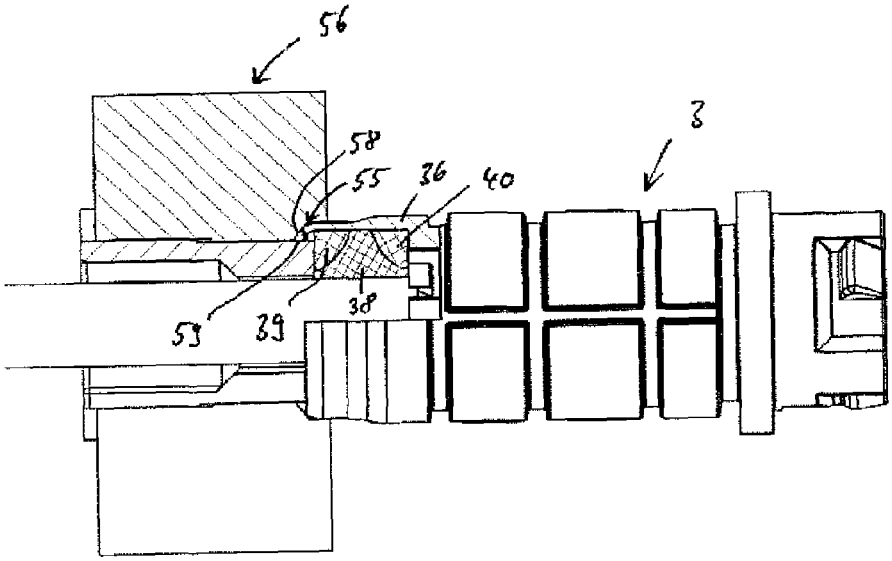

Embodiments of the invention are explained in more detail below based on schematic drawings. There show:

FIG. 1 an exploded view of the first plug part of the electrical plug-in connector;

FIG. 2 a perspective illustration of the plugged first plug part according to FIG. 1 with partially cut or broken-away partial illustration;

FIG. 3 a perspective illustration of an embodiment of a second plug part of the plug-in connector, wherein a partial region of the second plug part is illustrated cut or broken away;

FIG. 4 a side view of the plug parts of the plug-in connector connected to each other, wherein a partial region is illustrated cut or broken away;

FIG. 5 a side view of the completely connected plug parts with partially cut or broken-away illustration;

FIG. 6 a further side view of the plug parts in a first intermediate separation state upon automatic disconnection of the plug parts with partially cut or broken-away illustration;

FIG. 7 a side view of the two plug parts in a further intermediate separation state upon the intermediate separation state shown in FIG. 6 with partially cut or broken-away illustration;

FIG. 8 a side view of a partial region of the second plug part illustrated in enlarged manner;

FIG. 9 a side view of a plug part with a die for bending a rear border of the plug housing in a first assembly state; and FIG. 10 a side view of the plug part according to FIG. 9 with a die for bending a rear border of the plug housing in a second assembly state.

In the figures, identical or functionally identical elements are provided with the same reference characters.

In FIG. 1, a first plug part 1 of an electrical plug-in connector 2 is shown in an exploded illustration. The plug-in connector 2, which can also be referred to as plug-in connector device or plug-in connector coupling and is formed for electrical connection of a defibrillator to a power supply, moreover includes a second plug part 3 (FIG. 3) not shown in FIG. 1. The two plug parts 1 and 3 can be reversibly coupled and again disconnected. The first plug part 1 includes a plug housing or a plug housing 4 formed of metal. It is formed for receiving a cable 5 and moreover it also serves for receiving a support 6 for electrical contacts.

The contact arrangement of the first plug part 1 is also defined by the support 6. Moreover, the plug housing 4 also serves for receiving a cable seal 7, which also serves for strain relief. On both sides of this annularly circumferential and bead-like formed cable seal 7, pressure rings 8 and 9 are provided, which are disposed in the interior of the plug housing 4 in the assembled state of the first plug part 1.

Moreover, the plug housing 4 also serves as a support for a torsion spring 10. It is positioned on an outer side 11 of the plug housing 4 and formed circumferentially around the axial longitudinal axis A of the plug-in connector 2 and thus also of the first plug part 1. The spring 10 formed as a torsion spring has ends 12 and 13. They are correspondingly bent, wherein the end 12 engages behind a retaining leg 14 formed on the outer side 11. The second end 13 engages with a socket in the interior of a retaining sleeve 15 formed integrally of plastic. The retaining sleeve 15 formed hollow-cylindrical circumferentially surrounds the front region of the plug housing 4. Thus, the retaining sleeve 15 is attached to and disposed on the first plug part 1 and moreover rotatable relatively with respect to the plug housing 4 around the axis A. This is allowed by the spring 10.

In the assembled state of the plug part 1, the spring 10 is disposed in the interior of the retaining sleeve 15. A stop 17 is formed on the plug housing 4.

On an inner side 18 of the retaining sleeve 15, besides the socket for the end 13 of the spring 10, further detents or retainers are also formed. They then serve for receiving and retaining a spring element 19, which can also be referred to as a spring cage. The spring element 19 is completely disposed in the interior of the retaining sleeve 15 in the assembled state of the first plug part 1. Moreover, it encompasses the front region of the plug housing 4 and thus also encompasses the outer side 11.

As it is appreciable in the illustration according to FIG. 1, the spring element 19 is formed as an annular section and thus not a completely closed ring. The spring element 19 has a discontinuity 20. Thus, it is formed as a non-closed hollow cylinder. In the plate-like or strip-like wall 21 of the spring element 19, holes 22, 23 and 24 are formed. In each one of these holes 22 to 24, a spring piece 25, 26 and 27 is respectively integrally formed. The spring element 19 is integrally fabricated.

At a lower border 28 of the wall 21 of the spring element 19, a wall extension 29 is formed viewed in axial direction, but which is not formed over the entire circumferential length of the lower border 28. By this wall extension 29, a locking possibility is provided. This wall extension 29 is inserted or pushed into the detent or retainer for the spring element 19 formed at the inner side 18 upon introducing into the retaining sleeve 15. Thereby, the spring element 19 can be rotationally fixedly connected to the retaining sleeve 15.

The three spring pieces 25 to 27 in the embodiment are disposed equidistantly to each other viewed in circumferential direction. With regard to the configuration, they are identically formed. With respect to the further explanation, thus, only the spring piece 25 is explained in more detail. The spring piece 25 is also strip-shaped formed and includes a first strip part 30 disposed slightly inwardly bent or inclined. The first strip part 30 then leads to a second strip part 32 at a transition edge 31, which is oppositely slightly outwardly bent.

As is apparent, the spring piece 25 is disposed and flexibly movable such that it is flexibly movable and resilient especially in radial direction to the axis A. In particular, the strip parts 30 and 32 are also reversibly and non-destructively movable or deformable relatively to each other, which is essential for presetting a specific release force threshold value, if the spring piece 25 is pressed radially outwards to the inner side 18 of the sleeve 15 and deformed there by a raised release element upon axial automatic disconnection of the plug parts 1 and 3.

In FIG. 2, in the perspective illustration, the first plug part 1 is shown in the assembled state. Therein, the illustration is shown partially cut or partially broken-away in the region of the retaining sleeve 15. On an outer side 33 of the retaining sleeve 15, identifications are attached, which signal the rotational direction possibilities of the retaining sleeve 15, wherein for example an arrow 34 is presented. The retaining sleeve 15 is retained in a preloaded locking position by the spring 10 in a state non-operated by the user and thus in an initial position. Furthermore, it is provided that the retaining sleeve 15 can be rotated in circumferential direction around the axis A in an angular range of less than 60° in order to get from the locking position to a release position.

With regard to the locking position, that position is meant, in which a spring piece, for example the spring piece 25, of the spring element 19 is retained preloaded in a final position in a sliding guide of the second plug part 3 in circumferential direction around the axis A. In the release position of the retaining sleeve 15, then, this spring piece 25 is brought from the retained final position in the sliding guide into such a position that the spring piece 25 can then be moved in an axial guide path section of the sliding guide by exclusively axial movement and the plug parts 1 and 3 can be disconnected by axially moving away from each other.

However, this release position of the retaining sleeve 15 then has to be retained by a user, since upon releasing the retaining sleeve 15, it then is automatically again brought into the initial position and thus the locking position by the spring 10.

In FIG. 2, moreover, an exterior sheathing part 35 is shown, which is fitted to the plug housing 4 in the rear region. A front end 43 of the plug housing 4 is shown.

In FIG. 3, in perspective illustration, the already mentioned second plug part 3 is shown. Here too, a partial region is illustrated cut or broken away such that it can be looked at the interior. The second plug part 3 also includes a base part or plug housing 36 formed of metallic material. Here too, this plug housing 36 is formed for receiving a cable 37, a cable seal 38 shown in the cut or broken-away portion of the illustration, as well as a first pressure ring 39 and a second pressure ring 40. Here too, the plug housing 36 includes a stop 41 with a front side 42.

Here too, the plug housing 36 is provided for receiving a support 44, which represents the contact arrangement and is formed for receiving electrical contacts.

In a front region 45 of the plug housing 36, a plurality of sliding guides for each one of the spring pieces 25, 26 and 27 is formed on an outer side 46. The number of the sliding guides corresponds to the number of the spring pieces 25 to 27 of the spring element 19. Thus, three sliding guides are provided in the embodiment. Furthermore, only the sliding guide 47 completely represented in FIG. 3 is explained. The other two sliding guides are analogously formed. The sliding guide 47 includes a guide section 48 exclusively axially extending, which transitions into an exclusively horizontally or circumferentially oriented guide path section 49. The bounding edges of the guide path sections 48 and 49 near the bottom are therefore in particular disposed at an angle of 90° to each other.

Immediately adjacent and adjoining to the sliding guide 47, a raised release element 50 is formed. Thus, it is also virtually disposed downwardly recessed with respect to the level of the outer side 46. The release geometry in the form of the raised release element 50 includes a first abutment flank 51, which extends starting from an upper release edge 52 downwardly sloping to the bottom of the sliding guide 47. Moreover, the raised release element 50 includes a second abutment flank 53, which inclines downwardly sloping starting from the release edge 52 into the other direction and terminates at or leads to the front end 54 of the plug housing 36. The raised release element 50 is therefore formed as a hill or ramp downwardly sloping on both sides. In the embodiment, it is provided that the release edge 52 constitutes the peak of the release geometry and thus of the raised release element 50 (viewed in radial direction). In the embodiment, it is provided that the release edge 52 is on the vertical level of the outer side 46 and therefore does not protrude beyond the outer side 46 in radial direction.

It can be appreciated that the raised release element 50 both bounds the horizontal guide path section 48 with one side and bounds the horizontal guide path section 49 with the first abutment flank 51 on one side.

A substantial feature of the raised release element 50 is founded in that it is rectilinearly formed viewed in circumferential direction around the axis A. This means that the release edge 52 is located on the same longitudinal section along the axis A in axial direction viewed over the entire width (extension around the axis A). The corresponding also applies to the first abutment flank 51 for its border terminating at the bottom of the sliding guide 47.

By the configuration of the sliding guide 47 and in particular of the raised release element 50, in effective connection with the spring element 19 and the retaining sleeve 15, multifunctional and multi-optional disconnection and connection of the plug parts 1 and 3 can be achieved.

In this connection, it is therefore possible that automatic disconnection of the plug parts 1 and 3 is effected. To this, it is provided that the automatic disconnection is effected by exclusive transfer or pull-off of the spring piece, for example of the spring piece 25, over the raised release element 50 exclusively in axial direction.

In this connection, it is explained that in the plugged final state of the two plug parts 1 and 3, the spring pieces 25, 26 and 27 are each disposed in the associated sliding guides. For the further explanation in this respect, it is provided that the spring piece 25 is coupled to the sliding guide 47 and the raised release element 50. Thus, in the plugged state of the plug parts 1 and 3, the front second strip part 32 is then disposed such that it embraces the raised release element 50. This means that it comes to lie on the first abutment flank 51 and thus is furthermore located in the horizontal guide path section 49. The strip part 32 is urged into the final position by the retaining sleeve 15 due to its preloaded locking position and thus retained preloaded in the horizontal guide path section 49 behind the raised release element 50 viewed in axial direction.

If a tensile force with a value greater than this release force threshold value is then exerted on the plug parts 1 and 3, thus, the automatic disconnection of the plug parts 1 and 3 is effected. Therein, the release and thus the beginning of the axial movement of the spring piece 25 is first preset in defined manner by the defined inclination of the first abutment flank 51. Then, the spring piece 25 is pulled over the raised release element 50 with its front free strip part 32 exclusively in axial direction. Therein, the spring piece 25 is urged radially outwardly by the abutment flank 51 and pressed to the inner side 18 and deformed. If the tensile force is effected on the plug parts 1 and 3 as large as deformation of the strip parts 30 and 32 allows sliding of the spring piece 25 over the release edge 52, whereby the release force threshold value is exceeded, thus, the two plug parts 1 and 3 are automatically disconnected.

In addition to this automatic disconnection, user-defined and user-performed disconnection can also be effected. Therein, it is then provided that the retaining sleeve 15 is gripped by the user and rotated in arrow direction 34 such that the release position is achieved starting from the locking position. This is haptically perceived by the user by a stop of the retaining sleeve 15 in the release position. In this release position, the spring piece 25 is then moved from its position behind the raised release element 50 along the horizontal guide path section 49. In particular, the second strip part 32 is therefore only moved along the first abutment flank 50 along the horizontal guide path section 49 in circumferential direction and thus moved past the raised release element 50 in circumferential direction. In the release position of the retaining sleeve 15, the spring piece 25 and in particular the second strip part 32 is then at the upper end of the axial guide path section 48. This guide path section 48 is as wide in circumferential direction as it at least has the width of the spring piece 25 such that upon exclusively axial movement and with the retaining sleeve 15 retained in the release position, disconnection of the two plug parts 1 and 3 performed by the user can be effected. Therein, the spring piece 25 is then moved past the raised release element 50 along the axial guide path section 48 and then the two plug parts 1 and 3 are disconnected. If the retaining sleeve 15 is then again released, it is automatically moved into its locking position on the first plug part 1 by the spring 10.

The raised release element 50 and in particular the width of the release edge 52 as well as thereby also the width of the first abutment flank 51 viewed in circumferential direction is preferably at least dimensioned just as the spring piece 25, in particular the second strip part 32, is wide.

Besides the explanations to the two optional possibilities of disconnecting the connected plug parts 1 and 3, multi-optional assembly of the two plug parts 1 and 3 can also be effected.

Thus, in this connection, it can be provided that on the one hand first the retaining sleeve 15 is rotated from the locking position into the release position and then the two plug parts 1 and 3 are axially pushed together. With such an approach, then, due to the codings of the plug parts 1 and 3 and thus the relative orientation thereof in circumferential direction around the axis A for basic capability of plugging together, a situation is achieved in which then the spring piece 25 is automatically guided along the axial guide path section 48. If the maximum possible position of the two plug parts 1 and 3 pushed together is then reached in axial direction, by rotating back the retaining sleeve 15 or releasing the retaining sleeve 15, it is automatically rotated by the spring 10 and returned into the locking position. Therein, due to the rotationally fixed coupling of the spring element 19 to the retaining sleeve 15, the spring piece 25 is moved along the horizontal guide path section 49 and guided behind the raised release element 50. By the spring 15 and its preloading action, then, this state and the position of the spring piece 25 is retained.

With regard to the embracement of the spring piece 25 in the plugged state of the plug parts 1 and 3, starting from consideration performed in axial direction, this is to be understood such that starting from the front border 54 of the plug housing 36, the second strip part 32 comes to lie behind the raised release element 50.

However, it can also be provided that for connecting the plug parts 1 and 3, an exclusively axial connection movement is performed as a further option. With this approach, then, it is not required that first the retaining sleeve 15 is rotated from its locking position into the release position. Rather, with the correct orientation of the two plug parts 1 and 3 viewed in circumferential direction and thus with corresponding capability of assembling due to the coding, a purely axial connection movement can here be performed. Therein, due to the radial elastic movability of the spring piece 25, it is ensured that it is continuously moved over the second abutment flank 53 and continuously pressed outwards. Then, it is pushed over the release edge 52 and then continuously brought into the final position via the again downwardly sloping first abutment flank 51. In particular, the spring piece 25 is again radially moved inwards in order to then reach the embracing state of the raised release element 50 and the final position in the horizontal guide path section 49.

In FIG. 3, it is furthermore shown that a rear border 55 of the plug housing 36 is circumferentially inwardly oriented to the axis A. Thereby, it is advantageously achieved that the components in the interior of the plug housing 36 are also retained in axially positionally fixed manner. By the bending or crimping of the border 55, the cable seal 38 and the pressure rings 30 and 40 can no longer axially exit the plug housing 36.

This diameter restriction of the plug housing at the rear border 55 is achieved by a tool shown in FIG. 9, in particular a die 56. It is pushed onto the plug part 3 else completely equipped from behind and approached to the rear end of the plug housing 36. The die 56 has a socket 57. The rear end of the plug housing 36 is received in it. Upon further axially pushing the die 56 to the plug housing 36, then, the rear border 55 not yet bent comes into contact with a conically shaped abutment surface 58 of the socket 57. Upon further axially pushing together, the rear border 55 is then bent inwardly by the abutment surface 58, wherein a corresponding bending guide is formed by the socket 57. By a lower axially oriented resting surface 59 adjoining to the abutment surface, then, the bending path and thus also the diameter restriction is preset and limited. Thus, by the die 56, the desired intensity of the bending of the border 55 is allowed in very precise and defined manner. In FIG. 10, a partial section of the plug part 3 with already partially bent border 55 is shown thereto.

In FIG. 4, in a side view with illustration partially cut or broken away in the region of the retaining sleeve 15, the completely connected state of the plug parts 1 and 3 is shown. Here, it can be particularly precisely perceived that the second strip part 32 substantially abuts on the first abutment flank 51 with large area.

In particular, it can also be perceived that the front border 54 of the plug housing 36 of the second plug part 3 comes to lie on a step-like stop on the outer side 11 of the plug housing 4.

In FIG. 5, in a side view with partially cut or broken-away illustration, an implementation is shown, in which the plug parts 1 and 3 are also illustrated in the completely assembled state. Unlike the illustration according to FIG. 4, here, the reversed variant is shown such that here the first plug part 1 is positioned on the right and the second plug part 3 is positioned on the left. Moreover, the cut or broken-away illustration is also shown at another location to the illustration in FIG. 4.

Starting from the completely connected state of the plug parts 1 and 3 in FIG. 5, the above already mentioned automatic release functionality is further explained. To this, it can be recognized in the illustration according to FIG. 6 that a first intermediate separation state is achieved. If therein a tensile force in the direction of the arrow Z is for example exerted on the first plug part 1, the force value of which is greater than the release force threshold value of the plug-in connection device 2, thus, the automatic disconnection is effected. Therein, as already above explained, due to the configuration of the sliding guide 47 and the raised release element 50 as well as the configuration of the spring piece 25, exclusively a movement in axial direction and thus in the direction of the axis A is performed.

As is further shown in the illustration according to FIG. 7, in which a side view with partially cut or broken plug-in connector 2 is shown and in which a second separation intermediate state is presented, the spring piece 25 is then further guided along the second abutment flank 53 downwardly sloping in the direction of the axis A.

In FIG. 8, a side view of the plug part 3 in an enlarged illustration is shown. The geometry and the position of raised release elements 50 as well as sliding guides 47 respectively provided with the same reference character are shown. It can be appreciated that the axial side of the raised release element 50 facing away from the guide path section 48 is in the same position in circumferential direction around the axis A as the axial wall bounding the guide path section 49 at the end side. Furthermore, by the line B it is shown that among other things the release edge 52 extends on the same axial section over its entire width. Moreover, preferred inclination angles of 10° and 30° of the abutment flank 53 and the abutment flank 51, respectively, with respect to the axis A are drawn.

The invention claimed is:

1. A plug-in connector with a first and a second plug part, which can be reversibly coupled and disconnected, wherein a connection device is formed, which has at least one spring element, which engages with a sliding guide in the second plug part with at least one spring piece for connecting the plug parts, wherein the sliding guide and the spring element are formed such that upon exceeding a release force threshold value automatic disconnection of the plug parts is provided, wherein a raised release element is formed on the sliding guide, which is embraced by the spring piece in the plugged state of the plug parts, wherein the raised release element is formed rectilinearly in a circumferential direction around the longitudinal axis (A) and extends on the same axial sectional level over its width viewed in an axial direction, such that upon occurrence of a tensile force greater than the release force threshold value on the plug parts, the spring piece is guided over the raised release element exclusively in an axial direction for automatic disconnection of the plug parts, wherein the spring element is received in the interior of a retaining sleeve and is disposed rotationally fixedly on the retaining sleeve.

2. The plug-in connector according to claim 1, wherein the raised release element has an upper release edge, which transitions into a first abutment flank downwardly sloping when viewed in an axial direction on the side facing away from the front end of the second plug part, wherein the first abutment flank leads to the bottom of the sliding guide.

3. The plug-in connector according to claim 1, wherein the raised release element has an upper release edge, which transitions into a second abutment flank downwardly sloping when viewed in an axial direction on the side facing the front end of the second plug part, which terminates at the front end of the second plug part.

4. The plug-in connector according to claim 1, wherein the raised release element has a width corresponding at least to the width of the spring piece.

5. The plug-in connector according to claim 1, wherein a hollow-cylindrical retaining sleeve is disposed on the first plug part and is rotatable relative to the first plug part.

6. The plug-in connector according to claim 1, wherein at a lower border of the spring element, a wall extension only partially circumferential over the length of the lower border is formed, which is formed for introducing into a detent on the inner side of the retaining sleeve.

7. The plug-in connector according to claim 1, wherein the retaining sleeve is disposed on the first plug part in its initial position non-operated by a user in a locking position preloaded with respect to the connection of the two plug parts by a spring.

8. The plug-in connector according to claim 7, wherein the disconnection and the connection of the two plug parts can be also effected by rotating the retaining sleeve from the locking position into a release position and axially moving the plug parts towards each other besides the axial movement and the axial guide of the spring piece over the raised release element effected thereby, and wherein the spring piece is guided past the raised release element in axial direction in a guide path section of the sliding guide formed next to the raised release element, bounded by the raised release element on one side.

9. The plug-in connector according to claim 1, wherein the sliding guide has a guide path section horizontal in circumferential direction, which is bounded by the raised release element on one side and in which the spring piece is retained by a preloaded locking position of the retaining sleeve in the plugged state of the plug parts.

10. A plug-in connector with a first and a second plug part, which can be reversibly coupled and disconnected, wherein a connection device is formed, which has at least one spring element, which engages with a sliding guide in the second plug part with at least one spring piece for connecting the plug parts, wherein the sliding guide and the spring element are formed such that upon exceeding a release force threshold value automatic disconnection of the plug parts is provided, wherein a raised release element is formed on the sliding guide, which is embraced by the spring piece in the plugged state of the plug parts, wherein the raised release element is formed rectilinearly in a circumferential direction around the longitudinal axis (A) and extends on the same axial sectional level over its width viewed in an axial direction, such that upon occurrence of a tensile force greater than the release force threshold value on the plug parts, the spring piece is guided over the raised release element exclusively in an axial direction for automatic disconnection of the plug parts, wherein the spring element is a hollow-cylindrical annular section, in which the at least one spring piece is integrally formed and disposed in a hole of a wall of the annular section.

11. The plug in connector according to claim 1, A plug-in connector with a first and a second plug part, which can be reversibly coupled and disconnected, wherein a connection device is formed, which has at least one spring element, which engages with a sliding guide in the second plug part with at least one spring piece for connecting the plug parts, wherein the sliding guide and the spring element are formed such that upon exceeding a release force threshold value automatic disconnection of the plug parts is provided, wherein a raised release element is formed on the sliding guide, which is embraced by the spring piece in the plugged state of the plug parts, wherein the raised release element is formed rectilinearly in a circumferential direction around the longitudinal axis (A) and extends on the same axial sectional level over its width viewed in an axial direction, such that upon occurrence of a tensile force greater than the release force threshold value on the plug parts, the spring piece is guided over the raised release element exclusively in an axial direction for automatic disconnection of the plug parts, wherein the spring piece has two strip parts movable angled to each other and reversibly to each other and connected to each other, wherein the release force threshold value is adjustable at least by a presettable deformability upon pressing the spring piece to an inner side of the retaining sleeve upon guiding the spring piece over the raised release element upon automatic disconnection.

12. The plug-in connector according to claim 1, wherein a rear border of a plug housing of the second plug part is inwardly oriented towards the longitudinal axis (A) and a diameter restriction of the plug housing is formed by the border and wherein a retaining device for axial positional fixation of components introduced into the plug housing is formed by the inwardly oriented border.

13. A method for reversibly connecting and disconnecting plug parts of a plug-in connector, wherein a connection device is formed, which has at least one spring element, which engages with a sliding guide in the second plug part with at least one spring piece for connecting the plug parts, wherein upon exceeding a release force threshold value automatic disconnection of the plug parts is effected, wherein a raised release element is formed on the sliding guide, which is embraced by the spring piece in the plugged state of the plug parts, and upon occurrence of a tensile force greater than the release force threshold value on the two plug parts upon automatic disconnection of the plug parts, the spring piece is pulled off exclusively in axial direction over the raised release element formed rectilinearly in a circumferential direction and extending on the same axial sectional level over its width viewed in an axial direction, wherein the spring element is disposed internally in a retaining sleeve rotatably disposed on the first plug part in a rotationally fixed manner to the retaining sleeve and the embracement of the raised release element by the spring piece is retained by a state of the retaining sleeve preloaded in the circumferential direction by a spring viewed in the circumferential direction.

14. The method according to claim 13, wherein in addition to the automatic disconnection, user-directed disconnection can be performed such that a retaining sleeve rotatably disposed on the first plug part is brought from its locking position preloaded by a spring into a release position by gripping the retaining sleeve and rotating by a user, whereby the spring piece is moved past the raised release element horizontally in a circumferential direction, and then upon reaching the release position, it is moved along an axial guide path section of the sliding guide extending past the raised release element and adjoining to the raised release element by axially moving, and the plug parts are disconnected.

* * * * *